United States Patent [19]

Kurtz

[11] 4,360,109

[45] Nov. 23, 1982

[54] DEVICE FOR SUPPORTING WEARING APPAREL

[76] Inventor: Larry E. Kurtz, 7433 Popp Rd., Fort Wayne, Ind. 46825

[21] Appl. No.: 133,502

[22] Filed: Mar. 24, 1980

[51] Int. Cl.[3] ..... A47F 5/08

[52] U.S. Cl. ..... 211/100; 211/105.1

[58] Field of Search ..... 211/100, 99, 105.1, 211/60 T; 248/300

[56] References Cited

U.S. PATENT DOCUMENTS

| | | | |
|---|---|---|---|
| 287,655 | 10/1883 | French | 211/100 |
| 748,719 | 1/1904 | Germain | 211/100 |
| 1,497,209 | 6/1924 | Chapman | 211/100 |
| 2,460,505 | 2/1949 | Jahoda | 211/100 |
| 2,469,208 | 5/1949 | Rothrock | 211/100 |
| 3,721,348 | 3/1973 | Cook | 211/60 T |

FOREIGN PATENT DOCUMENTS

| | | | |
|---|---|---|---|
| 951154 | 10/1949 | France | 211/100 |

*Primary Examiner*—Roy D. Frazier
*Assistant Examiner*—Robert W. Gibson, Jr.
*Attorney, Agent, or Firm*—Charles S. Penfold

[57] ABSTRACT

The invention involves a device or assembly comprising an elongated rack and a plurality of rods which are readily detachably connectible to the rack for lateral positioning with respect thereto for preferably supporting wearing apparel.

7 Claims, 9 Drawing Figures

DEVICE FOR SUPPORTING WEARING APPAREL

BACKGROUND OF INVENTION

It is recognized that a multitude of different devices or equipment have heretofore been employed for supporting wearing apparel and other articles too numerous to particularize and that many U.S. Pat. Nos. have issued, including the following which were discovered during a search: Daniel Miller 121,953 issued Dec. 19, 1871; John H. French 287,655 issued Oct. 30, 1883; T. M. Anderson 528,498 issued Oct. 30, 1894; George S. Griner 1,732,162 issued Oct. 15, 1929; Louis Judelson 1,833,022 issued Nov. 24, 1931; Aaron Wolf 1,883,219 issued Oct. 18, 1932; and William J. Jahoda 2,460,505 issued Feb. 1, 1949.

OBJECTIVES

One of the important objectives of the subject invention is to provide a device or assembly which embodies improved principles of design and construction which are not present in the Patents above referred to or in any other devices presently known to the inventor.

A primary objective of the invention is to provide an elongated rack or structure having a pair of walls having spaced apart portions which are respectively provided with longitudinally spaced oppositely disposed receiving means which are designed and constructed in a manner whereby a plurality of rods can be readily manipulated so their inner extremities will be received by, engage or cooperate with said receiving means and so that their outer extremities will extend transversely outwardly from the rack for use in supporting garments or other articles desired.

More particularly, an objective of the inventon is to provide one form of a rack which is preferably constructed from a single piece of sheet material, such as sheet metal, which can be shaped or folded to provide a channel structure having a planar base or bottom wall, an upstanding planar rear or back wall, an upstanding planar front wall, and an intermediate planar wall which is joined to the rear wall and depends therefrom to a position between and in spaced relation to the rear and front walls. This intermediate or depending wall and the front wall are those referred to in the preceding paragraph which are provided with the receiving means which respectively receive or accommodate the inner extremities of the rods.

In view of the foregoing, a specific, but very important object of the invention is to provide certain of the receiving means in a lower marginal edge portion or area of the intermediate or depending wall and certain of the other receiving means in an upper marginal edge portion or area in the upturned front wall. Each of the receiving means in the depending wall is preferably in the form of a relatively wide V-shaped notch having a substantially semi-circular or concave seat and each of the receiving means in the front wall is also preferably in the form of a relatively wide V-shaped notch having a semi-circular or concave seat, the notches in the front wall being respectively located opposite to those in the depending wall, all of which will be described more in detail subsequently.

Another object of the invention is to design and construct the receiving means in a manner whereby the rods may be caused to automatically or self-adjust themselves in the receiving means when they are more or less loosely incorrectly positioned therein.

Also, an object is to provide means for reinforcing or stabilizing the relative positions of the walls forming the rack or channel structure.

An additional object is to provide rods which are inflexible and have enlargements or head portions which are adapted for disposition between the back and depending walls or in a chamber formed thereby.

A further object of the invention is to provide a channel structure which also serves as a storage space for the rods when not in use or to facilitate packaging for shipment.

A still further objective is to provide the rear wall of the rack or structure with a plurality of longitudinally spaced apertures through which fastening means, such as screws, can be extended for mounting the rack to a vertical wall or other support and providing the depending or intermediate wall with a plurality of longitudinally spaced openings which are disposed opposite the apertures so that a tool, such as the blade of a screwdriver can be inserted for manipulating the screws.

A particularly significant objective of the subject invention is to provide a modified rack structure or assembly which embodies certain improved principles of design and construction which are different from those in the rack structure above referred to.

Additional objectives and advantages of the invention will become apparent after the description hereinafter set forth is considered in conjunction with the drawings annexed hereto:

Figure 1:
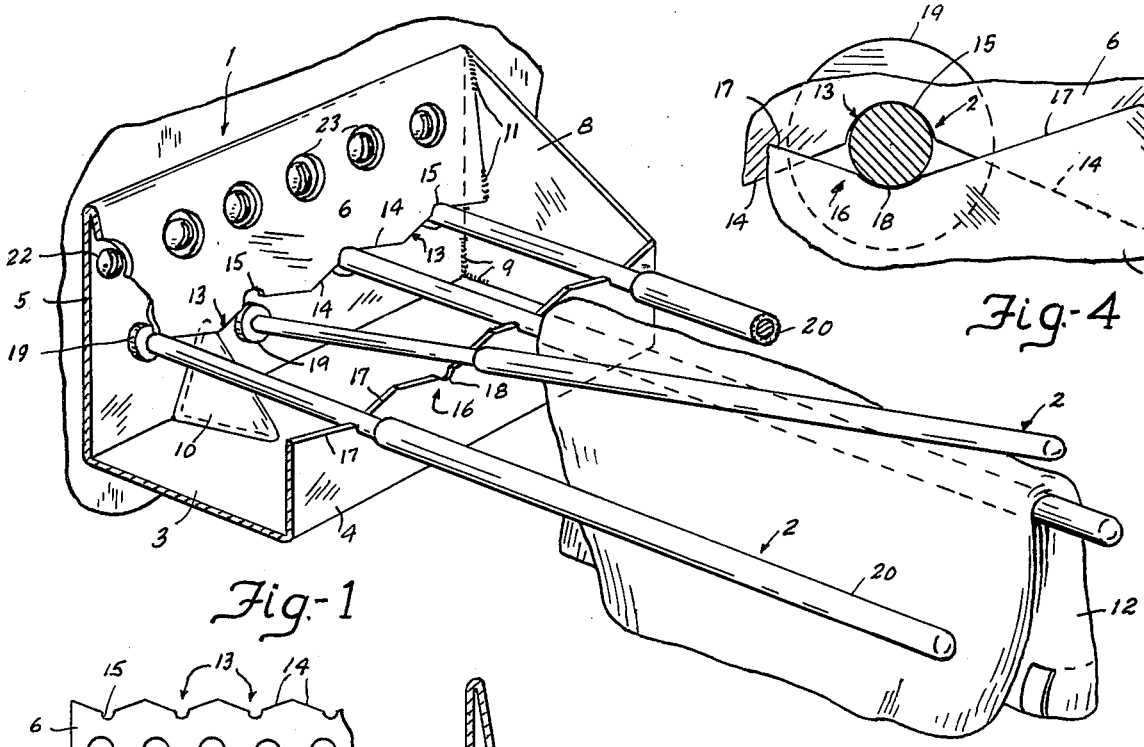
FIG. 1 is a perspective view of a rack attached to a wall and provided with rods, with one of the latter supporting a garment.
Figure 4:
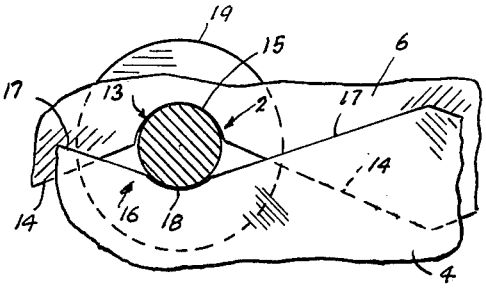
FIG. 4 is an enlarged partial frontal view of the rack depicting the position a rod in a pair of aligned receiving means.
Figure 2:
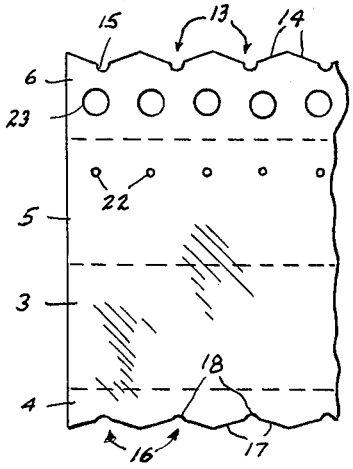
FIG. 2 is a partial surface development of the rack.
Figure 3:
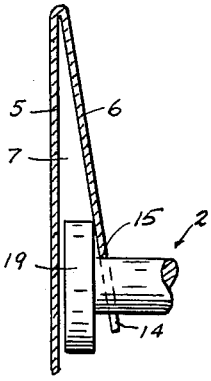
FIG. 3 is a partial vertical section of the rack showing an enlarged end portion of a rod held in place between opposed walls of the rack.

Referring to the drawings and particularly to FIGS. 1, 2, 3, 4 and 6 there is disclosed a rack structure or assembly generally designated 1 and rods generally designated 2.

The rack 1 may be designed and constructed in various ways but is preferably constructed from a single piece of sheet material, such as sheet metal, which is shaped or folded to form a planar bottom wall 3, a planar upstanding or upturned front wall 4, a planar upstanding or upturned rear wall 5, and a planar intermediate or depending wall 6 which is joined to the rear wall and located between and in spaced relation to the rear and front walls. All of the aforesaid walls are preferably substantially co-extensive with one another and the rear wall 5 is preferably parallel to the front wall 4 and extends upwardly a predetermined distance which is greater than the height of this front wall. The depending wall 6 is preferably disposed in an acute angular relationship to the rear wall so that they form a chamber 7, the purpose of which will be described subsequently.

Figure 6:
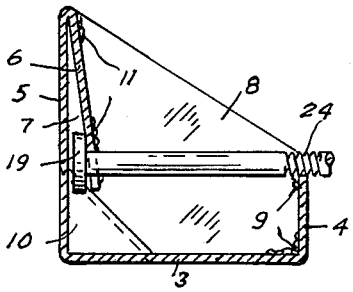
FIG. 6 is transverse sectional view of the rack shown in FIG. 1 and a rod, the latter of which is provided with means which serves to cooperate with a receiving means in a front wall of the rack for the purpose of connecting opposed walls of the rack and assist in limiting rotation of the rod about its longitudinal axis.

The sheet metal utilized is preferably of a sufficient thickness and character that the walls will substantially retain the original shapes to which they have been formed. If so desired, the rack may include a pair of planar end walls 8 (one shown) which are preferably secured to the rear and front walls by soldering or spot welding as indicated at 9 whereby to import stability to the structure and particularly to the back and front walls. Also, if so desired, the back and bottom walls can be reinforced or stabilized by indents or deformations 10 as shown in FIGS. 1 and 6. It is obvious that indents may be employed to reinforce the bottom and front walls. Stability can also be imparted to the back and depending walls by spot welding or soldering as indicated at 11. Although not disclosed in the drawings, the end walls 8 may constitute integral continuations of the bottom wall.

As alluded to above one of the primary objectives of the subject invention is to respectively provide the front and depending walls 4 and 6, which constitute a pair of opposed walls, with means for receiving or accommodating inner extremities of a plurality of rods, such as 2, which rods serve as hangers or supports for wearing apparel, such as pants 12, or any other article or articles desired.

More particularly, the lower longitudinally extending marginal edge portion or area of the depending or opposed wall 6 is provided with a plurality of longitudinally spaced receiving means generally designated 13, each of which is preferably in the form of a relatively wide notch or cut-out defined by a pair of convergent straight marginal edges 14 which terminate in an inner seat 15, the latter of which is preferably semi-circular in shape and has a maximum cross-dimension or diameter somewhat slightly greater than the diameter or cross dimensions of the rods so that the latter will loosely nest or rest in the seats 15.

The front or opposed wall 4 has an upper longitudinal marginal edge portion or area which is provided with a plurality of longitudinally spaced receiving means generally designated 16, preferably in the form of relatively wide V-shaped notches, each of which is defined by a pair of straight convergent marginal edges 17 which terminate in a concave or semi-circular seat 18 for receiving an inner extremity of a rod 2.

Attention is directed to the fact that the receiving means 16 in the front wall 4 are respectively disposed transversely opposite the receiving means 13 provided in the depending wall 6. Otherwise expressed, the seats 18 in the front wall 4 are disposed opposite or aligned with the seats 15 so that when the inner extremities of the rods are respectively engaging the seats, the rods will be correctly held in a horizontal position to locate their outer extremities transversely outward from the rack for use. When the rods are so held, their longitudinal axes are respectively aligned or disposed in a coincident relationship with the axis of the concave seats.

Attention is also directed to the fact that the seats 15 in the depending wall 6 are longitudinally spaced apart the same distance as the seats 18 in the front wall 4 and this spacing is predetermined in order to readily facilitate detachable connection of the rods to the rack and placement and removal of garments or other articles on the rods or hangers 2 without disturbing garments on adjacent rods. Obviously, the number of receiving means is determined by the length of a rack.

Each of the rods 2, is preferably constructed in the form of a length of cylindrical metal stock, the uniform diameter of which is preferably a few thousands less than that of the maximum cross-dimension of the seats 15 and 18 so that the inner extremity of each rod will correctly nest or engage these seats.

The inner ends of the rods 2 are preferably provided with enlargements or heads 19 which when located between the rear wall 5 and depending wall 6 or in the chamber 7 formed by these walls serve to limit axial movement of the rods outwardly and rearwardly because the aforesaid walls serve as abutments or stops. The outer extremity of each rod is preferably coated or encased in a sleeve or layer of rubber 20 which extends throughout the major portion of the length of each rod to offer frictional resistance in order to assist in preventing or retarding release of any garment carried by a rod.

It should be observed that the heads 19 have a uniform axial dimension and a uniform diameter and that they are preferably of a predetermined size and shape so that they are more or less loosely disposed in the chamber 7 due to spacing between the back and depending walls.

Due to design and construction of the notches constituting the receiving means 13 and 16 and the rods, and particularly to the convergent, inclined or sloping edges 14 and 17 defining the notches, the rods will more or less automatically adjust themselves into the seats. Thus, if, for example, an inner extremity is placed on a marginal edge 17 of a notch 18, the rod, due to the weight of its outer extremity and/or the additional weight of a garment thereon will cause the rod to slide, ride, fall or adjust itself into a seat 18 and/or into a seat 15.

More particularly in the above respect the rods are interchangeable and detachably connectible with the rack. The arrangement is preferably such that each rod can be tilted so that its head can be located in the chamber or space 7 and then lowering its outer extremity to locate its inner extremity in the seats or the inner extremity can be first located in a seat 18 and then tilted so that its head is located in the chamber and its inner extremity will be located in a seat 15.

The rack 1 is preferably designed and constructed for mounting in a horizontal position against a vertical wall as shown in FIG. 1, such as an inner wall of a clothes closet or other support, and in order to facilitate mounting, the rear wall 5 is preferably provided with a plurality or row of longitudinally spaced apertures 22 through which fastening means, such as screws can be inserted for entry into a support and the depending wall 6 is preferably provided with a plurality or row of longitudinally spaced openings 23 through which a tool, such as the blade of a screwdriver can be inserted for manipulating the screws.

The rack, in addition to supporting the pants 12, can be readily utilized to support other garments and neckties, or belts by threading a rod, for example, through buckles of the belts.

Figure 5:
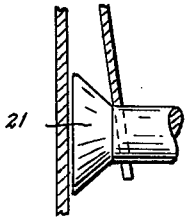
FIG. 5 is a partial section showing a rod having a different end enlargement or head held in place between opposed walls of the rack.

If so desired, the rods may be provided with end enlargements or heads of a different shape. For example, as depicted in FIG. 5 they may be more or less truncated in shape having a taper 21 which assists in piloting the head into the chamber 7. Also, if so desired, each rod may be provided with means, such as a threaded, knurled or roughened portion 24 for engagement with a seat 18 in order to assist in preventing a rod from rotating about its longitudinal axis and assist in more or less tying or connecting the depending and front walls whereby to impart stability thereto.

Figure 7:
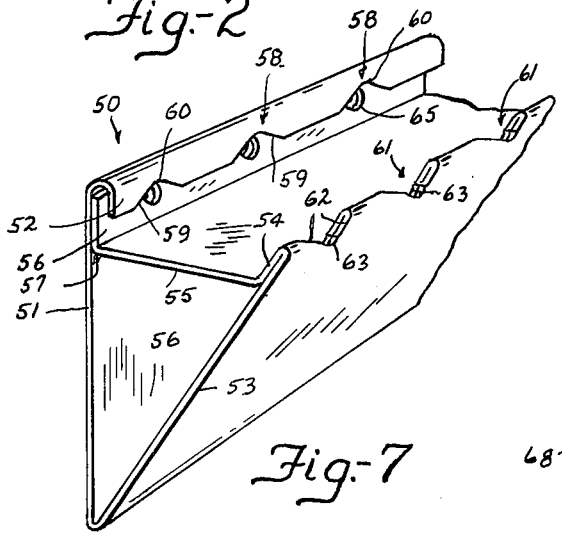
FIG. 7 is a partial perspective view of modified form of a rack which embodies certain principles of design and construction which are not present in the structure illustrated in FIGS. 1 through 6.
Figure 8:
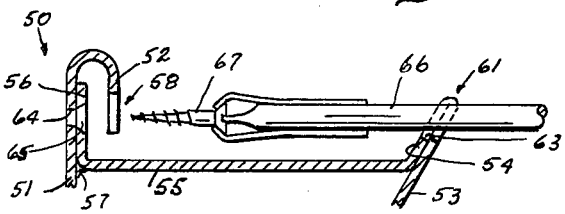
FIG. 8 is a transverse section of FIG. 7 showing a mode of attaching the rack to a wall.
Figure 9:
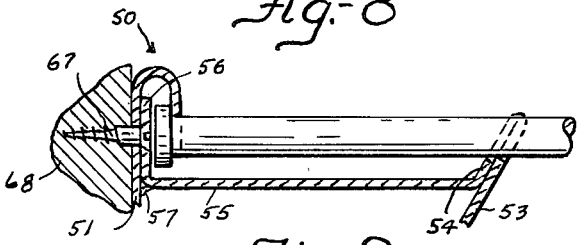
FIG. 9 is a transverse section similar to FIG. 8 depicting the rack secured to a wall and a rod attached to the rack.

As alluded to above, the invention contemplates utilization of a modified rack or structure which is exemplified in FIGS. 7, 8 and 9. This rack is generally designated 50 and preferably constructed of relatively heavy gauge sheet metal and is folded or shaped to provide a planar upstanding back wall 51 having a continuation which is turned over to form a depending or opposed planar wall 52 which is disposed in a predetermined spaced parallel relationship to the back wall. The rack also includes what may be termed an opposed or inclined planar wall 53 which is disposed in an acute angular relationship to the back wall and provided with a continuation which is folded over to form an inclined or opposed planar wall 54 overlapped against the wall 53. This continuation also includes a planar horizontal top or bridging wall 55 having a rear planar upturned or upstanding wall or lip 56 which extends into a chamber or space between the back and depending walls 51 and 52 and against the back wall. The walls 51, 53 and 55 form an elongated chamber 56 and the top wall 55 serves to more or less connect or bridge the opposed walls 51 and 53 and may serve as a platform or tray for holding articles and the chamber and platform are usuable for storing one or more rods or other items. If desired, the lip 56 can be fastened to the back wall 51 by welding 57.

The lower longitudinal marginal edge portion of the depending or opposed wall 52 is provided with a plurality of corresponding longitudinal spaced receiving means preferably in the form of relatively wide V-shaped notches generally designated 58, each of which is defined by a pair of converging marginal edges 59 which terminates in a concave seat 60. The upper longitudinal portion of the wall 53 and the inclined or overlapping wall 54 constitutes a double wall structure which is provided with a plurality of longitudinally spaced receiving means preferably in the form of relatively V-shaped notches generally designated 61, each of which is defined by a pair of edges 62 which terminate in a concave seat 63. Then notches 61 are disposed transversely opposite to the notches 58 in the depending wall 52 and serve to detachably accommodate the inner extremities of rods such as those described above including the rod shown in FIG. 9. The rods can be readily connected to the rack 5 in modes as substantially described above with respect to the rack 1, so that the heads 19 or 21 are located in the space or chamber between the walls 52 and 56, the latter of which limit rear and forward movement of the rods once they are located in the seats.

The rack 50 can be mounted in any manner desired and the back wall 51 is preferably provided with a plurality of longitudinally spaced openings 64 and the upturned lip or wall 56 with corresponding openings 65 which are aligned with the openings 64 and the notches 60 and 61, the arrangement preferably being such that a blade 66 of a screwdriver, as depicted in FIG. 8, may be utilized to drive a fastening means, such as a screw 67 through the openings 64 and 65 into a wall 68 or other support for mounting the rack in a horizontal position as shown in FIG. 9 and so that the rods when correctly connected to the rack their outer extremities will extend outwardly from the rack for use. It should be observed that the aligned notches 58 and/or 61 afford clearance for the blade 66 of the screwdriver.

It should be noted that screws 67 serve the dual purpose of attaching the rack to a supporting wall 68 and locking the upturned wall 56 to the back wall 51 and that the notches 58 and 61 serve to accommodate the inner extremities of the rods as well as clearance to facilitate use of a screwdriver in locating screws through the openings 64 and 65.

In view of the foregoing it should be manifest that each of the racks embody the invention or inventions. The racks have actually been utilized and have proven to by very stable, durable and practical in supporting wearing apparel.

Having thus described the embodiments of the invention or inventions, it is obvious that various other modifications or additions to those illustrated and described may be made in the same without departing from the spirit of the invention or inventions and therefore it is not intended to place any limitations as to the exact forms, constructions, arrangements and combinations of the components herein shown and described.

I claim:

1. A device for the purpose described comprising an elongated structure having an inner wall and an upturned wall disposed in front of said inner wall in spaced relation thereto, said inner wall having a lower substantially planar longitudinally extending continuation having a marginal edge portion provided with longitudinally spaced receiving means, said upturned wall having an upper longitudinally extending marginal edge portion provided with second longitudinally spaced receiving means which are respectively disposed opposite to said firstmentioned receiving means, the arrangement being such that one or more elongated headed rods can be readily manipulated so that their inner extremities will engage certain of said receiving means and said upturned wall constitutes a fulcrum for positioning one or more of said headed rods to locate their outer extremities substantially horizontally, perpendicular and forwardly of said upturned wall for supporting one or more articles, at least each of said certain of said first-mentioned receiving means comprises an inset seat which will receive an inner extremity of a rod and relatively long straight edges which converge upwardly into the seat and may be selectively engaged by an inner extremity whereby to facilitate its entry into the seat and each of said second receiving means comprises an inset seat and a pair of long straight edges which converge downwardly into said seat, and said heads of such rods being adapted for disposition between said inner wall and its continuation which serve as abutments to limit rear and forward movement of such rods when they are positioned in aligned pairs of seats.

2. A device of the kind described comprising an elongated structure which is constructed to provide an upturned rear wall, an upturned front wall and a depending intermediate wall disposed between and in spaced relation to said rear and front walls, said intermediate wall being provided with a row of longitudinally spaced receiving means, said front wall being provided with a row longitudinally spaced receiving means which are respectively disposed opposite to the receiving means in said intermediate wall, each of said receiving means comprising a seat and a pair of edges which converge into said seat, the arrangement being such that inner extremities of elongated rods can be manipulated for selective disposition in pairs of the oppositely disposed seats or may be guided therein by engaging one or more of said converging edges in a manner whereby to hold the rods so that their outer extremities will extend laterally in parallel relation from the structure for use in supporting articles, said device also having a bottom wall coextensive with said rear and front walls upon which one or more rods may be supported lengthwise thereon, and said rods having heads for disposition between said rear and intermediate walls which serve as abutments whereby to limit forward and rearward movements of said rods when disposed in aligned pairs of seats.

3. An elongated unitary one piece structure of the kind described comprising a bottom wall, an upstanding rear wall, an upturned front wall disposed in parallel relation to said rear wall and having an upper marginal edge portion provided with longitudinally spaced relatively wide notches, said rear wall is provided with an integral wall depending between and in spaced relation to said rear and front walls and has a lower marginal edge portion which is provided with longitudinally spaced relatively wide notches which are respectively disposed opposite to said first mentioned notches, each of said notches being defined by a seat and a pair of long edges which converge into said seat, the arrangement being such that an elongated rod can be manipulated for disposition in any pair of oppositely disposed seats or may engage any one or more of said long edges to facilitate self entry of the rod into at least one of the seats whereby to position an outer extremity of the rod perpendicular to and forwardly of said front wall for supporting an article, and said bottom, rear and front walls forming a shallow channel for receiving one or more rods with the latter being supported lengthwise on said bottom wall.

4. A device for the purpose described comprising an elongated channel structure defined by a bottom wall, a front upstanding planar wall and a rear upstanding wall disposed substantially in parallel relation to said front wall and provided with an integral continuation which extends forwardly and downwardly to provide an intermediate wall substantially between said front and rear walls and in combination with said rear wall defines a chamber, said rear wall being provided with apertures through which fasteners may be extended for attaching the structure to a support and an upper portion of said intermediate wall being provided with openings larger than said apertures which are respectively aligned therewith through which a tool may be inserted for manipulating the fasteners, said front wall having an upper portion provided with longitudinally spaced relatively wide notches of which each is defined by a pair of downwardly converging edges which terminate in a seat, said intermediate wall having a lower portion provided with longitudinally spaced relatively wide notches of which each is defined by a pair of upwardly converging edges which terminate in a seat, said seats in said front and intermediate walls being aligned whereby to accommodate one or more headed rods for disposition perpendicular to the length of the structure, the arrangement being such that a rod can be manipulated directly into a pair of seats with its head disposed in the chamber or automatically ride into one or a pair of seats by one or more of said edges when engaged by the rod, and said rear and intermediate walls serve as abutments engageable by one or more heads of rods for limiting axial movement of the rods when the latter are correctly disposed in said seats.

5. A device for the purpose described comprising an elongated channel structure defined by a bottom wall, a front upstanding wall and a rear upstanding wall disposed substantially in parallel relation to said front wall and provided with an integral continuation which extends forwardly and downwardly to provide an intermediate wall between said front and rear walls and in combination with said rear wall defines a chamber, means for facilitating attachment of the structure to a support, said front wall having a portion provided with a plurality of longitudinally spaced inset seats and said intermediate wall having a portion provided with a plurality of longitudinally spaced inset seats which are opposite the seats in the front wall to provide aligned pairs of seats for accommodating the inner extremities of headed rods with the heads disposed in the chamber, at least one of said portions adjacent a seat being provided with converging edges of which at least one edge may serve to automatically guide the rod into the seat, and said bottom, rear and front walls forming a shallow channel for storing therein and lengthwise upon said bottom one or more rods.

6. A device for the purpose described which is formed with a bottom wall, an upstanding front wall having an upper longitudinal portion provided with a plurality of longitudinally spaced inset front seats, a rear wall provided with means facilitating attachment of the device to a support and with an intermediate depending wall having a lower longitudinal portion disposed in a spaced opposed relation to said upper portion and provided with a plurality of longitudinally spaced rear inset seats which are respectively axially aligned with the front seats to provide aligned pairs of seats for selectively accommodating an inner extremity or extremities of one or more elongated rods, and said upper portion also being provided with a pair of edges which respectively converge downwardly into said front seats to define relatively wide V-shaped notches whereby said edges may be utilized to facilitate entry of a rear extremity of a rod into any of said front seats, and said bottom, front and rear walls forming a shallow channel in which one or more rods may be stored therein lengthwise on said bottom wall.

7. A device for the purpose described comprising structure formed with an upstanding front wall having an upper longitudinal portion provided with a plurality of longitudinally spaced front seats, a rear wall provided with apertures through which means may be extended for attaching the device to a support and with an intermediate wall having a lower longitudinal portion disposed in opposed spaced relation to said upper portion and provided with a plurality of longitudinally spaced inset rear seats which are respectively axially aligned with said front seats to provide aligned pairs of seats for selectively receiving an inner extremity or extremities of one or more elongated rods, said lower portion also being provided with pairs of edges which respectively converge upwardly into said rear seats to define relatively wide inverted V-shaped notches whereby said edges may serve to automatically cause a rear extremity of a rod to enter any of said rear seats, said intermediate wall being provided with openings larger than said aperture through which a tool may be extended for manipulating the attaching means, and said heads of said rods being adapted for disposition between said rear and intermediate walls for limiting axial movement of the rods when correctly positioned in aligned pairs of seats.

* * * * *